United States Patent [19]

Onda et al.

[11] 4,441,966

[45] Apr. 10, 1984

[54] ELECTROPLATING APPARATUS AND METHOD

[75] Inventors: Tsutomu Onda, Nishio; Keiichi Kano, Nagoya; Shinji Itakura, Hekinan, all of Japan

[73] Assignee: Aisin Seiki Kabushiki Kaisha, Kariya, Japan

[21] Appl. No.: 312,354

[22] Filed: Oct. 16, 1981

[30] Foreign Application Priority Data

Oct. 16, 1980 [JP] Japan ..... 55-144889

[51] Int. Cl.[3] ..... C25D 7/04; C25D 17/00; C25D 17/06

[52] U.S. Cl. ..... 204/26; 204/275; 204/224 R; 204/297 R; 204/225

[58] Field of Search ..... 204/224 R, 275, 297 R, 204/26, 225

[56] References Cited

U.S. PATENT DOCUMENTS

| | | | |
|---|---|---|---|
| 3,647,671 | 3/1972 | Abt | 204/275 X |
| 3,891,515 | 6/1975 | Paulson et al. | 204/275 X |
| 4,096,042 | 6/1978 | Looney et al. | 204/26 X |
| 4,246,088 | 1/1981 | Murphy et al. | 204/275 X |

*Primary Examiner*—Donald R. Valentine

*Attorney, Agent, or Firm*—Oblon, Fisher, Spivak, McClelland & Maier

[57] ABSTRACT

A plating apparatus for plating a member which includes a casing having a chamber formed therein for housing the member to be plated, an inlet port for receiving plating fluid, and an outlet port for discharging the plating fluid, the inlet and outlet ports being in communication with each other through the chamber wherein the casing further includes a first member having the inlet and outlet ports formed therein, and a second member connected to the first member, an electrode operatively associated with the member to be plated, an actuating mechanism for disconnecting the second member from the first member and a mechanism for supplying the plating fluid to the inlet port.

7 Claims, 2 Drawing Figures

ELECTROPLATING APPARATUS AND METHOD

BACKGROUND OF THE INVENTION

1. Field of the Invention

This invention relates to an electroplating apparatus and method. More particularly, it relates to a electroplating apparatus having a casing through which plating fluid flows and to a method of electroplating using such apparatus.

2. Description of the Prior Art

The casing of the apparatus of this type includes a lower member for carrying a member to be plated, and an upper member detachably connected to the lower member. In the conventional casing, an inlet port for receiving plating fluid is provided in the upper member and includes an outlet port for discharging plating fluid therethrough. Upon mounting or removing of the member to be plated, the upper member is moved in the vertical direction. Thus, any pipe to be connected to the inlet port must of necessity be flexible. However, such piping construction is poor in quality of material and a connecting mechanism between the pipe and the inlet port is required. Therefore, the conventional plating apparatus has the drawback that a possibility of leakage exists.

SUMMARY OF THE INVENTION

Therefore, one of the objects of this invention is to provide a plating apparatus without the aforementioned drawbacks.

Another object of this invention is to provide a plating apparatus in which both an inlet port for receiving plating fluid and an outlet port for discharging plating fluid are provided in either an upper member or a lower member of a casing.

In accordance with the present invention, a plating apparatus for plating a member is provided which includes a casing having a chamber formed therein for housing the member to be plated, an inlet port for receiving plating fluid, and an outlet port for discharging the plating fluid. The inlet and outlet ports are in communication with each other through the chamber and the casing further includes a first member having the inlet and outlet ports formed therein, a second member connected to the first member, an electrode operatively associated with the member to be plated, an actuating mechanism for disconnecting the second member from the first member, and a mechanism for supplying the plating fluid to the inlet port.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
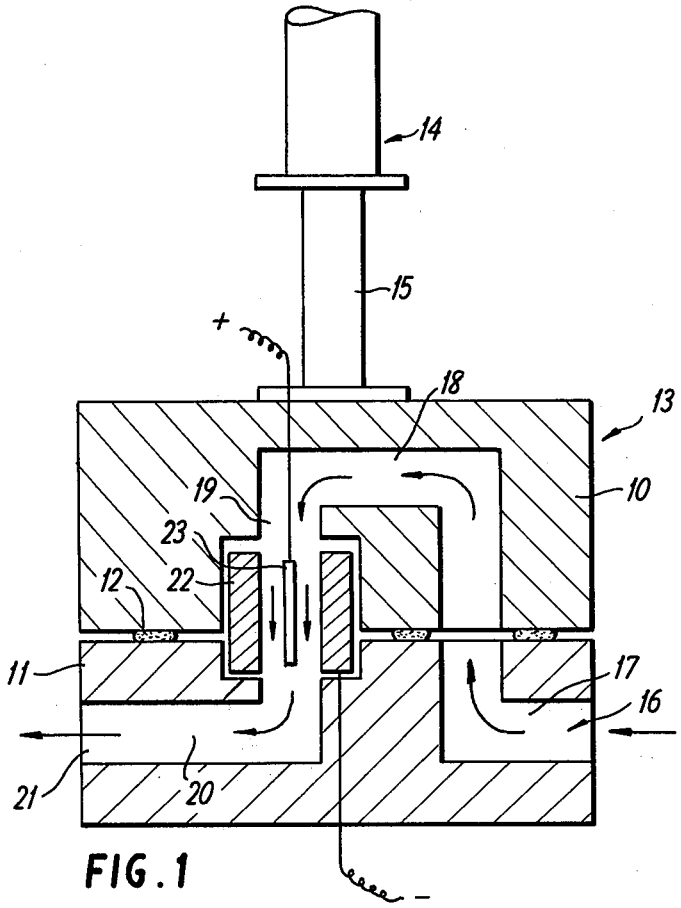
FIG. 1 is a sectional view of a first embodiment of a plating apparatus according to the present invention.

Referring now to FIG. 1, a casing 13 of a plating apparatus includes an upper member 10 and a lower member 11. Fluid-tight connection between both upper and lower members 10 and 11 is assured by a sealing member 12. Upper member 10 is connected to a piston 15 of an air cylinder 14 so as to move in the vertical direction in accordance with operation of air cylinder 14.

In the right side portion of lower member 11 is formed an inlet port 16 and a first passage 17 for connecting a second passage 18 formed in upper member 10 to inlet port 16. Second passage 18 is in communication with a chamber 19 in which a member 22 to be plated is positioned. Chamber 19 is formed at a contiguous portion of upper and lower members 10 and 11. Chamber 19 is in turn in communication with a third passage 20 and an outlet port 21 both of which are formed in lower member 11. Member 22 to be plated is electrically connected to a negative terminal of a power supply (not shown), and a positive electrode 23 electrically connected to a positive terminal of the power supply is positioned in member 22.

When plating fluid is supplied to inlet port 16 under such construction, the plating fluid flows through passage 17, passage 18, chamber 19, and passage 20, and is discharged from outlet port 21 as shown by the arrows. Thus, an inner wall of member 22 is plated. After upward movement of the upper member 10 occurs by actuation of air cylinder 14, member 22 is replaced with a new member to be plated and upper member 10 is in turn moved in a downward direction before the next plating procedure.

It is obvious from the aforementioned description that inlet and outlet ports 16 and 21 may be connected to rigid pipes and that effective connection between the rigid pipes and the inlet and outlet ports is assured, thereby eliminating the drawbacks which exist in the conventional apparatus.

Figure 2:
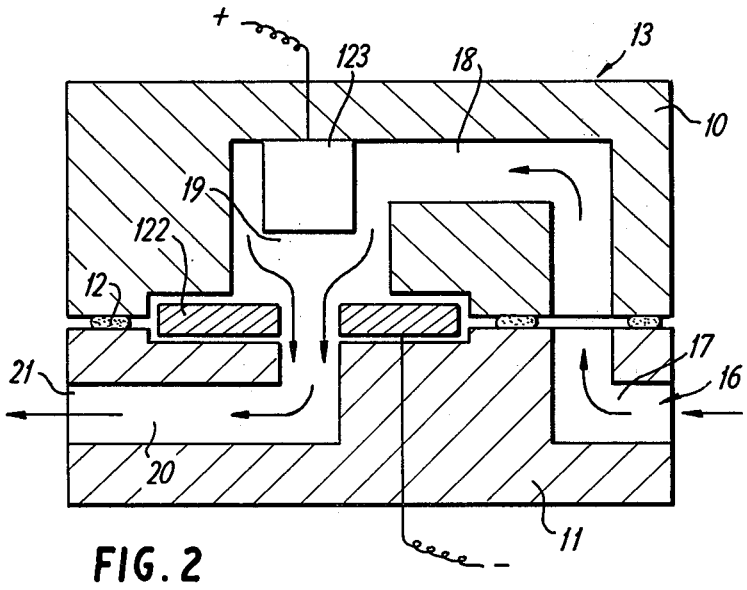
FIG. 2 is a sectional view of a second embodiment of a plating apparatus according to the present invention.

As seen from the illustration of the second embodiment in FIG. 2, a positive electrode 123 is positioned above an annular member 122 so as to plate an upper surface thereof. Further, the inlet and outlet ports may be provided in upper member 10 assuming that lower member 11 is movable by actuation of an air cylinder corresponding to air cylinder 14.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Apparatus for electroplating an article, said apparatus comprising:

(a) a first member having therein an inlet port into which plating fluid is supplied during plating operations, a first passageway in fluid communication with said inlet port and with a working face of said first member, an outlet port, and a third passageway in fluid communication with said outlet port and with said working face of said first member;

(b) a second member having therein a second passageway in fluid communication at both ends with a working face of said second member;

(c) the working faces of said first and second members defining a chamber therebetween which is in fluid communication with one end of said second passageway and with either said first passageway or said second passageway during plating operations, the other of said first or second passageways being simultaneously in fluid communication with the other end of said second passageway;

(d) said chamber being adapted to entirely contain the article to be plated during a plating operation such that the plating fluid flows through said chamber in one direction without doubling back on itself;

(e) first electrode means adapted to be operatively associated with the article to be plated; and (f) second electrode means positioned to cooperate with said first electrode means to electroplate the article.

2. Apparatus as recited in claim 1 and further comprising means for moving said second member away from said first member so that articles to be plated can be inserted into and removed from said chamber.

3. Apparatus as recited in claim 1 wherein said second electrode is displaceably mounted within said chamber.

4. Apparatus as recited in claim 1 wherein said chamber is sized such that there is a gap between the inner walls of said chamber and the outer walls of the article to be plated.

5. A method of electroplating an article, said method comprising the steps of:

(a) providing a first member having therein an inlet port into which plating fluid is supplied during plating operations, a first passageway in fluid communication with said inlet port and with a working face of said first member, an outlet port, and a third passageway in fluid communication with said outlet port and with said working face of said first member;

(b) providing a second member having therein a second passageway in fluid communication at both ends with a working face of said second member;

(c) the working faces of said first and second members defining a chamber therebetween which is in fluid communication with one end of said second passageway and with either said first passageway or said second passageway during plating operations, the other of said first or second passageways being simultaneously in fluid communication with the other end of said second passageway;

(d) placing the article to be plated in said chamber;

(e) connecting a first electrode means to the article to be plated;

(f) providing a second electrode means in position to cooperate with said first electrode means to electroplate the article;

(g) causing the plating fluid to flow through said chamber in one direction without doubling back on itself; and (h) providing an electroplating voltage differential between said first and second electrodes.

6. A method as recited in claim 5 and further comprising the steps of:

(a) moving said second member away from said first member and (b) removing a plated article from said chamber and inserting an article to be plated into said chamber while said second member is spaced from said first member.

7. A method as recited in claim 5 wherein said chamber is sized such that there is a gap between the inner wall of the chamber and the outer wall of the article to be plated.

* * * * *